United States Patent [19]

Yamasaki

[11] Patent Number: 4,777,940

[45] Date of Patent: Oct. 18, 1988

[54] PORTABLE MASSAGING APPARATUS HAVING VIBRATION ISOLATING MEMBERS ON WORM GEARS

[75] Inventor: Yoshikiyo Yamasaki, Osaka, Japan

[73] Assignee: Kabushiki Kaisha Fuji Iryoki, Osaka, Japan

[21] Appl. No.: 68,465

[22] Filed: Jun. 30, 1987

[51] Int. Cl.[4] ..... A61H 7/00

[52] U.S. Cl. ..... 128/46; 128/59

[58] Field of Search ..... 128/45, 46, 59, 60, 128/61; 267/136

[56] References Cited

U.S. PATENT DOCUMENTS

| | | | |
|---|---|---|---|
| 912,016 | 2/1909 | Miller | 128/45 |
| 1,377,140 | 5/1921 | North | 128/59 |
| 1,913,462 | 6/1933 | Timar | 128/60 |
| 1,931,849 | 10/1933 | Matson | 128/45 |
| 2,206,902 | 7/1940 | Kost | 128/46 |
| 2,232,493 | 2/1941 | Stuckey et al. | 128/67 |
| 2,806,470 | 9/1957 | Ferrier | 128/60 |
| 2,914,065 | 11/1959 | Cory | 128/45 |
| 3,001,523 | 9/1961 | Sugimoto | 128/59 |
| 3,322,117 | 5/1967 | McCaw | 128/46 |
| 3,374,784 | 3/1968 | Brent et al. | 128/61 |
| 3,625,204 | 12/1971 | Sekiguchi | 128/60 |
| 3,993,052 | 11/1976 | Miyahara | 128/46 |
| 4,016,872 | 4/1977 | Yamamora et al. | 128/46 |
| 4,282,768 | 8/1981 | Osborn | 74/473 R |
| 4,454,867 | 6/1984 | Swanson | 128/45 |
| 4,505,267 | 3/1985 | Inada | 128/59 |

FOREIGN PATENT DOCUMENTS

| | | | |
|---|---|---|---|
| 60-75060 | 4/1985 | Japan | 128/46 |

*Primary Examiner*—Charles Pearson
*Assistant Examiner*—Tonya Lamb
*Attorney, Agent, or Firm*—Flynn, Thiel, Boutell & Tanis

[57] ABSTRACT

A portable massaging apparatus comprises a pair of worm gears which engage with a worm on both sides thereof, a box within which the pair of worm gears are installed, and vibration isolating plates with one or more types of annular elastic projecting parts which are applied to the inner wall of said box at a certain pressure and are equipped on one or both sides of the upper and lower surfaces of the worm gears to prevent noise and vibration which occur when the worm gears rotate. In the portable massaging apparatus of this construction, little vibration is transmitted to the massaging balls and little resonance is transmitted from the case body, so that comfortable massage to parts, such as the back or the scruff of the neck of a user's body, can be provided, and acupressure effect can be expected.

7 Claims, 3 Drawing Sheets

PORTABLE MASSAGING APPARATUS HAVING VIBRATION ISOLATING MEMBERS ON WORM GEARS

This application is related to my copending application U.S. Ser. No. 021 117 filed Mar. 3, 1987.

BACKGROUND OF THE INVENTION

1. Field of the Invention

This invention relates to a portable massaging apparatus which is easy to carry and can be used by hand, comprising a pair of massaging balls which relatively circle to massage any part of a user's body by proper force. This apparatus has the same effect as conventional acupressure type massaging apparatus.

2. Description of Prior Art

It has previously been proposed to provide vibrator type massaging apparatus or massager type portable messaging apparatus including a pair of massaging balls or elements which tremble or relatively move and are applied released from a user's body. Recently, massager type massaging apparatus are popular because of the soft feel of their massaging balls.

Conventional known portable massaging apparatus comprises, as shown in FIG. 1, a pair of worm gears equipped on both sides of a worm 2 within a box 1, and massaging balls 5 connected to the top of shafts 4 of each worm gear 3 in line at a certain angle. Rotating said worm 2 by a motor M relatively circles said pair of massaging balls 5.

However, conventional portable massaging apparatus of the construction described above have a disadvantage in that noise and vibration may occur between the gears 3 because of the uneven size of said box 1 or the uneven contact ratio of the worm 2 and worm gears 3. Although the contacting points of the worm 2 and each worm gear 3 are greased in order to eliminate this problem, the problem of vibration remains uneliminated.

SUMMARY OF THE INVENTION

It is an object of the invention to provide a portable massaging apparatus for providing a comfortable massage, without noise and vibration, and a continuous massage of the affected part of a user by the relatively circling of a pair of massaging balls.

The portable massaging apparatus according to this invention comprises a pair of worm gears which engage with a worm on both sides thereof, a box within which the pair of worm gears are installed to freely rotate, and massaging balls connected to the top of the shaft of each worm gear in line at a certain angle to each shaft for helping the massaging balls relatively circle and is characterized in that vibration isolating plates with one or more sorts of annular elastic projecting parts are applied to the inner wall of said box at a desired pressure and are equipped on one or both sides of the upper and lower surfaces of said worm gears to prevent as much noise and vibration as possible that occur during the rotation of the worm gears. Detailed description of the portable massaging apparatus will be given below based on an embodiment shown in FIGS. 2–7.

PREFERRED EMBODIMENT OF THE INVENTION

Figure 1:
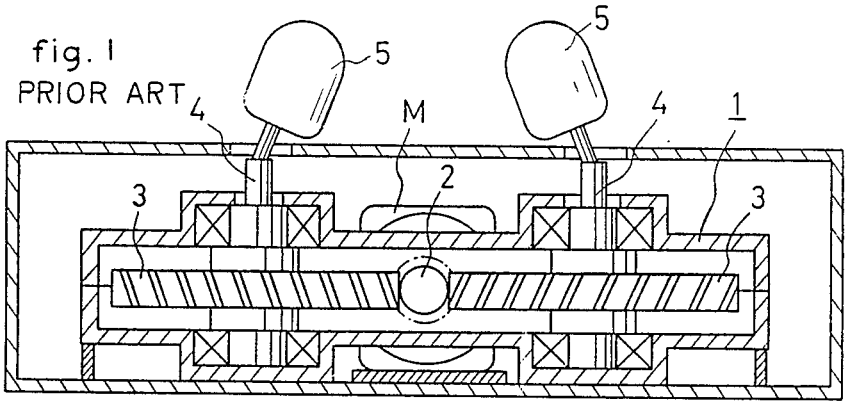
fig. 1 PRIOR ART
FIG. 1 is a central vertical sectional view of a portable massaging apparatus according to the prior art.

11 is a portable massaging apparatus according to this invention, 12 is a worm which is driven by a motor M, and 13 is a pair of worm gears which are equipped on both sides of said worm 12 to engage with said worm 12 and to rotate simultaneously in opposite directions.

14 is a box to receive and support said worm 12 and said worm gears 13. Bearings 15 are fixed on the upper and lower parts of the right and left portions of the inner wall of said box 14 to support shafts 16 of said worm gears 13 so that said shafts 15 can freely rotate.

17 is a vibration isolating rubber to prevent wobble between said bearings 15 and the shaft 16, but said vibration isolating rubbers 17 are not always necessary except in the case that said box 14 is made of resin which might deform and wobble.

19 is a rounded ball-like massaging element connected to the top of said shafts 16 through saucer-shape connecting members 18 in line at a certain angle to said shafts 16 so that each massaging ball 19 can relatively circle.

Furthermore, 20 is a case body supporting said massaging balls 19 which project outside said case 20 and said motor M and said box 14 are contained within said case 20 so that said massaging balls 19 can relatively circle. Handles 21 to carry said case body 20 are provided on both sides thereof.

22 is a ring-shape vibration isolating plate equipped on one or both of the upper and lower surfaces of said worm gears 13. Said vibration isolating plates 22 are provided with one or more annular elastic projecting parts 23 which are applied to said inner wall at a desired pressure to prevent noise of said worm gears 13 and vibration of said box 14 caused by rotation of said worm gears 13.

Figure 4:
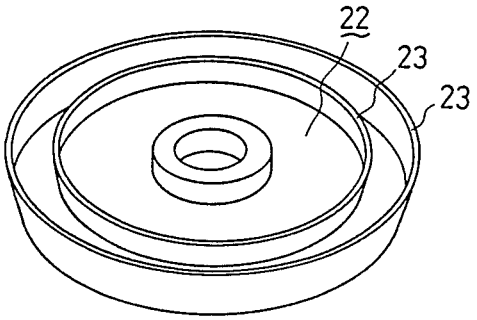
FIG. 4 is a perspective side view of a vibration isolating plate of an embodiment of this invention.
Figure 5:
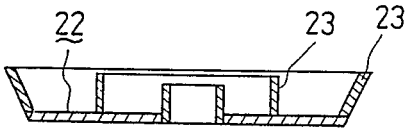
FIG. 5 is a central vertical sectional view of the vibration isolating plate of FIG. 4.
Figure 6:
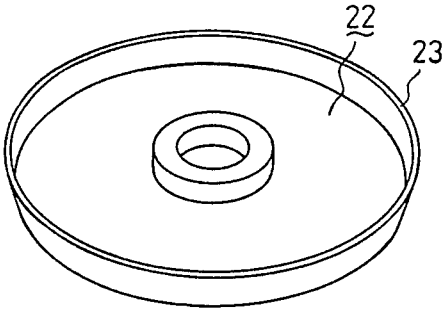
FIG. 6 is a perspective side view of another embodiment of a vibration isolating plate of this invention.
Figure 7:
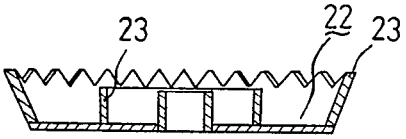
FIG. 7 is a central vertical sectional view of anotherembodiment of a vibration isolating plate of this invention.
Figure 8:
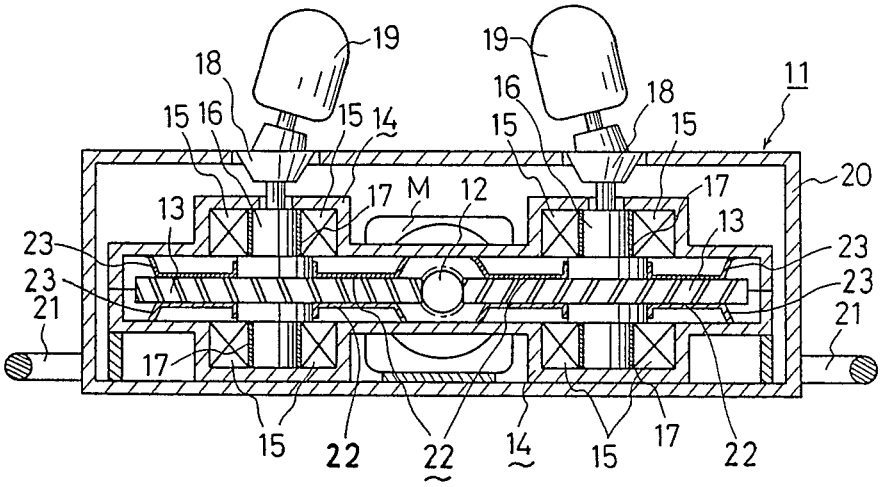
FIG. 8 is a central vertical sectional view similar to FIG. 2 but illustrating a variation wherein vibration isolating plates are disposed on both sides of the worm gears.

It is more effective, as shown in FIGS. 4 and 5, to equip said vibration isolating plate 22 with a plurality of concentric annular elastic projecting parts of different heights. It is also acceptable that said elastic projecting parts are serrated, as shown in FIG. 7, besides being of a constant height if they are annular.

Figure 2:
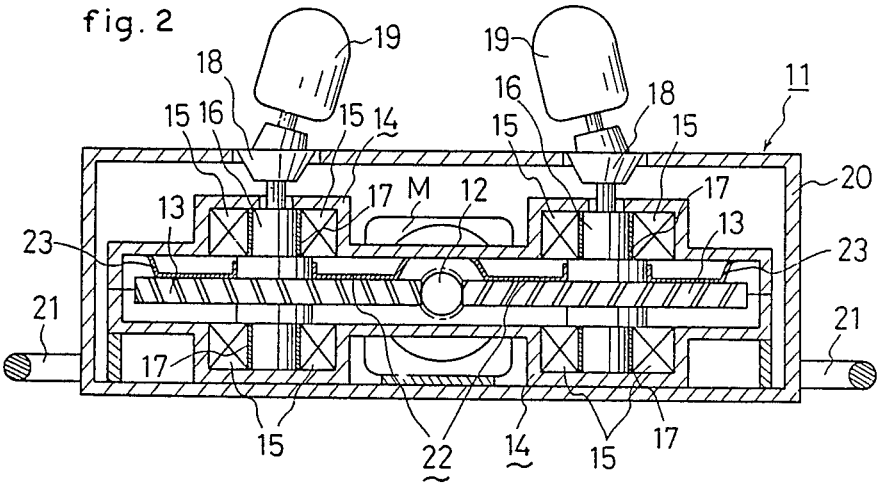
FIG. 2 is a central vertical sectional view of a portable massaging apparatus which is an embodiment of this invention.
Figure 3:
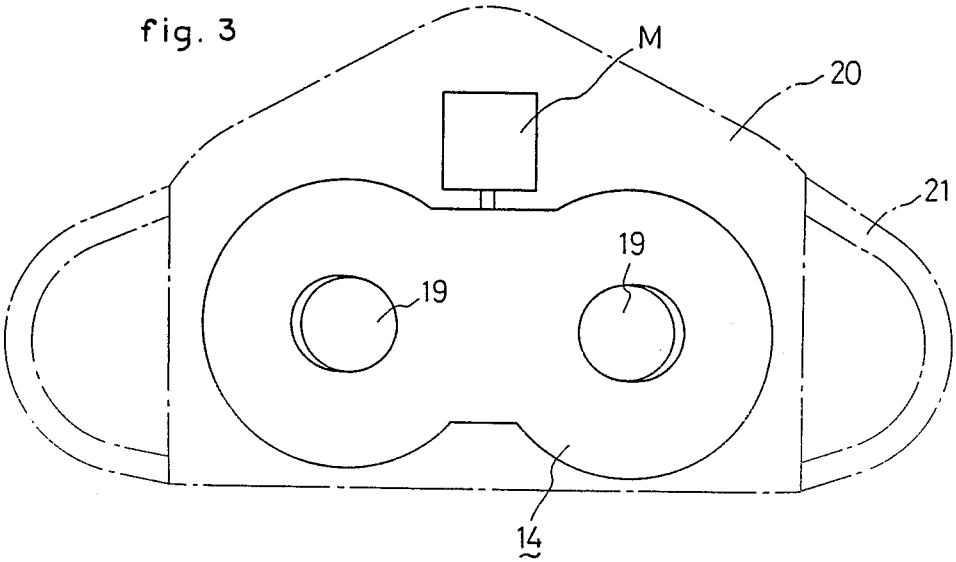
FIG. 3 is a plan view of a box of an embodiment of this invention.

Furthermore, said vibration isolating plates 22 are sufficiently effective for the prevention of noise and vibration even if equipped on only one of the upper or lower surfaces of each worm gear 13, as shown in FIG. 2. It is also acceptable to equip said vibration isolating plates 22 on both of the upper and lower surfaces of said worm gears 13, as shown in FIG. 1. This construction has the advantage of reducing the quantity of grease needed to fill said box so that said worm 12 can smoothly engage with said worm gears 13.

In operation, driving said motor M rotates said worm 12, and then said pair of worm gears 13 engaged with said worm 12 on both sides thereof rotate in the opposite directions to relatively circle said massaging balls 19 connected to the top of the shafts 16 of said worm gears 13. The back or the scruff of the neck of a user applied to said massaging balls 19 can be massaged without unpleasantness caused by noise and vibration.

What is claimed is:

1. A portable massaging apparatus comprising:

a box-like housing;

a box-like casing contained in said housing, said casing having upper and lower parts defining a space therebetween;

a motor contained in said housing;

a worm and a pair of worm gears contained in said casing, said worm being connected to said motor so that it is driven by said motor, and said worm gears being engaged with opposite sides of said worm so that the worm gears rotate simultaneously in opposite directions;

a worm gear shaft nonrotatably coupled to each worm gear, each worm gear shaft being disposed coaxially with and extending outwardly from upper and lower faces of the worm gear;

bearings contained in said upper and lower parts of said casing, said bearings being coaxial with and surrounding portions of said shafts that extend outwardly from the upper and lower faces of said worm gears;

upper vibration isolating plates provided on the upper face of said worm gears and maintained in elastic bearing engagement with an opposed surface on said upper casing part, said upper vibration isolating plates being coaxial and in contact with the worm gear shafts that extend outwardly from the upper face of the worm gears; and massaging elements disposed outside said housing, said massaging elements being connected to the tops of said worm gear shafts that extend outwardly from the upper faces of the worm gears, said tops of said worm gear shafts being disposed at an acute angle with respect to the axes passing through the upper and lower faces of said worm gears and extending through openings provided in said housing.

2. A portable massaging apparatus comprising:

a casing having upper and lower wall parts which define a space therebetween;

a pair of generally parallel shafts extending across said space so that opposite ends of said shafts are rotatably supported on said upper and lower wall parts, said shafts having parts on the upper ends thereof which project upwardly through said upper wall part;

a massaging element mounted on each of said shaft parts in upwardly spaced relationship from said upper wall part, said massaging element being disposed in offset relationship relative to the rotational axis of the respective shaft so as to undergo an orbital circular motion in response to rotation of the respective shaft, said massaging element having a generally rounded outer end surface;

a pair of worm gears disposed within said space, each said worm gear being nonrotatably and coaxially mounted relative to a respective one of said shafts;

worm means positioned within said space and rotatably supported on said casing, said worm means being positioned directly between said worm gears so that said worm gears meshingly engage the worm on diametrically opposite sides thereof so that rotation of the worm causes simultaneous rotation of the worm gears in opposite rotational directions;

motor means drivingly connected to said worm for causing said rotation thereof; and vibration isolating means coacting between said worm gears and said casing for minimizing transmission of vibration and noise, said vibration isolating means comprising a ring-shaped member disposed in concentric relationship relative to each of said shafts and having an annular elastic part disposed axially between one of said wall parts and an opposed side surface of the worm gear for applying elastic pressure against said last-mentioned wall part.

3. The apparatus of claim 2, wherein said vibration isolating member includes an annular hub part which concentrically surrounds the respective shaft, a generally flat wall which projects radially outwardly from the hub part and engages the side wall of the respective worm gear, and an annular elastic rim which is joined to the flat wall adjacent its radially outer edge and which projects axially therefrom so as to terminate in an annular free edge which resiliently bearingly engages a surface of said wall part.

4. The apparatus of claim 3, wherein a pair of said vibration isolating members are disposed on opposite axial sides of each said worm gear so as to engage opposite side surfaces of the worm gear and also engage opposed surfaces on the upper and lower housing parts.

5. The apparatus of claim 2, wherein said vibration isolating member has a second annular elastic rim attached to said flat wall and projecting axially therefrom toward said casing part for resilient engagement with a surface thereof, said second rim being generally concentric with but positioned radially inwardly from said first-mentioned rim.

6. The apparatus of claim 5, wherein said rims are of different axially-extending heights.

7. The apparatus of claim 6, wherein the free edge of one of said rims is of a serrated configuration.

* * * * *

UNITED STATES PATENT AND TRADEMARK OFFICE

CERTIFICATE OF CORRECTION

PATENT NO. : 4 777 940

DATED : October 18, 1988

INVENTOR(S) : Yoshikiyo YAMASAKI

It is certified that error appears in the above-identified patent and that said Letters Patent is hereby corrected as shown below:

Column 4, line 47; change "claim 2" to ---claim 3---.

Column 4, line 50; change "casing" to ---wall---.

Signed and Sealed this

Twenty-second Day of August, 1989

*Attest:*

DONALD J. QUIGG

*Attesting Officer*

*Commissioner of Patents and Trademarks*